United States Patent [19]

Kane et al.

[11] Patent Number: 4,768,669

[45] Date of Patent: Sep. 6, 1988

[54] FLEXIBLE SEALING TOP

[75] Inventors: Louis A. Kane, Shrewsbury; Herbert L. Bello, Cambridge, both of Mass.

[73] Assignee: Elkay Products, Inc., Shrewsbury, Mass.

[21] Appl. No.: 48,592

[22] Filed: May 11, 1987

[51] Int. Cl.[4] ..... B65D 53/00; B65D 41/00

[52] U.S. Cl. ..... 215/344; 215/353; 215/354; 215/DIG. 1; 215/DIG. 3

[58] Field of Search ..... 215/317, 344, 353, 354, 215/DIG. 3, DIG. 1

[56] References Cited

U.S. PATENT DOCUMENTS

| | | | |
|---|---|---|---|
| 1,504,698 | 8/1924 | Merolle | 215/317 |
| 1,802,739 | 4/1931 | Scofield | 215/317 |
| 3,069,040 | 12/1962 | Corsette | 215/344 |
| 3,247,994 | 4/1966 | Madsen et al. | 215/344 |
| 3,335,893 | 8/1967 | Hanson | 215/354 |
| 3,441,161 | 4/1969 | Van Baarn | 215/344 |
| 4,090,631 | 5/1978 | Grussen | 215/344 |
| 4,574,966 | 3/1986 | Sandhaus | 215/344 |
| 4,610,372 | 9/1986 | Swartzbaugh | 215/344 |
| 4,637,520 | 1/1987 | Alvi | 215/354 |
| 4,687,114 | 8/1987 | Crisci | 215/344 |

FOREIGN PATENT DOCUMENTS

| | | | |
|---|---|---|---|
| 1095370 | 6/1955 | France | 215/354 |

*Primary Examiner*—Stephen Marcus
*Assistant Examiner*—Nova Stucker
*Attorney, Agent, or Firm*—Herbert L. Bello

[57] ABSTRACT

A top for sealing an elongated tube such as a test tube, a blood drawing tube or the like has a tubular body with a closed upper end, a depending sidewall and an opened lower end which form an open ended tube receiving chamber. The lower end of the sidewall tapers outwardly and forms an enlarged entrance. An annular sealing rib, which is formed at the upper interior corner of the tubular body, extends inwardly into the tube receiving chamber and sealingly engages the lip of the tube when the top is in place. An annular gripping rib, which is formed in the sidewall below the sealing rib, grippingly and sealingly engages the sidewall of the tube. A lower rib, which is formed below the gripping rib, facilitates placing of the top on the tube and gradual breaking of the seal when the top is removed. A thumb tab at the lower end of the sidewall assists in the removal of the top from the tube.

16 Claims, 1 Drawing Sheet

FLEXIBLE SEALING TOP

BACKGROUND OF THE INVENTION

1. Field of the Invention

The present invention relates to tops for sealing containers and, more particularly, is directed towards a top for sealing elongated tubes such as test tubes, blood drawing tubes and the like.

2. Description of the Prior Art

Various types of tops have been designed for closing food containers. For example, French Pat. Nos. 1,236,076 and 1,241,271 show reusable caps for jars that contain food products. U.S. Pat. No. 4,542,833 shows a stretchable cap for sealing and/or resealing blood drawing tubes and the like. In the laboratory, it is often necessary to seal and reseal blood drawing tubes, test tubes, and the like as rapidly as possible. Typically, the technologist who is taking blood from a patient and filling a number of different blood drawing tubes does so in vacuum tubes through vacuum caps. These caps must be removed for processing of the samples collected and the tubes must then be recapped. Oftentimes, it is difficult and time consuming to replace the original top. A need has arisen for an improved top for sealing elongated tubular members such as test tubes, culture tubes, blood drawing tubes and the like.

SUMMARY OF THE INVENTION

It is an object of the present invention to provide a top for sealing the opened end of an elongated tubular member such as a test tube, a culture tube, a blood drawing tube and the like.

Another object of the present invention is to provide a top closure for sealing an elongated tubular member such as a test tube a blood drawing tube, a culture tube, and the like. The top has a tubular body with a closed upper end, a depending sidewall and an opened lower end. A tube receiving area or open ended chamber is formed by the closed end and depending sidewall. The lower end of the sidewall tapers outwardly to form an enlarged entrance at the opening of the tube receiving area. An annular interior sealing rib, which is formed at the upper interior corner of the tube receiving area, extends inwardly into the receiving area and is operative to sealingly engage the lip of the test on which the top has been placed. An annular interior gripping rib, which is formed in the sidewall below the sealing rib, grippingly engages the sidewall of the tube to be sealed. A lower rib, which is formed below the gripping rib, facilitates placing of the top on the tube and gradual breaking of the seal. A tab at the lower end of the sidewall defines a purchase for removing the top from the tube.

Other objects of the present invention will in part be obvious and will in part appear hereinafter.

The invention accordingly comprises the device together with its parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
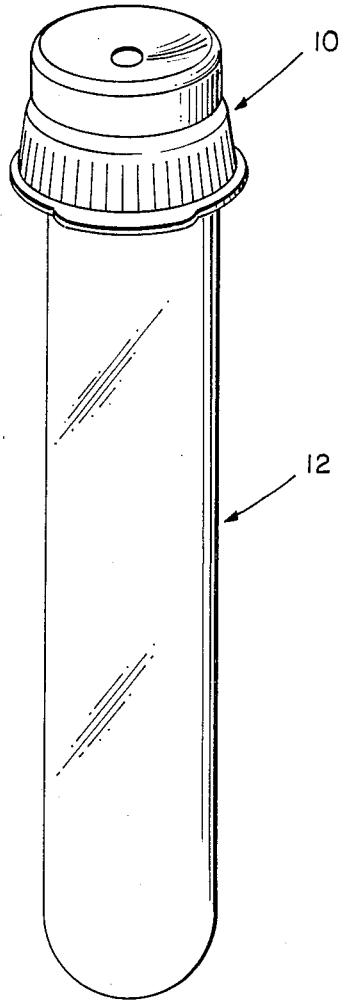
FIG. 1 is a perspective view of a top embodying the present invention and mounted on a test tube.

Referring now to the drawings, particularly FIG. 1, there is shown a top 10 made in accordance with the present invention. Top 10 is shown on the opened top end of an elongated tubular member 12, for example, a blood drawing tube, a test tube, a culture tube, and the like. In the illustrated embodiment, by way of example, elongated tubular member 12 is a test tube having an opened top end 14 with an annular rim 16 which projects outwardly beyond the surface of the test tube as shown in FIG. 2.

In the preferred embodiment, top 10 is integrally formed as a unitary member from a flexible or stretchable material, preferably polyethylene, by a molding technique. Top 10 includes a tubular body 18 with a closed upper end 20, depending sidewall 22 and an opened lower end 24. The lower end of sidewall 22 is formed with an outwardly tapering skirt portion 26 which defines an enlarged entrance for the top 14 of test tube 12. Closed end 20, depending sidewall 22 and opened lower end 24 define a tube receiving area or chamber 28 which is configured to receive the top end 14 of test tube 12. The lower end of skirt 26 has an outer annular band 30 which is provided with a tab or purchase 32 that facilitates removal of top 10 from the test tube 12.

Figure 2:
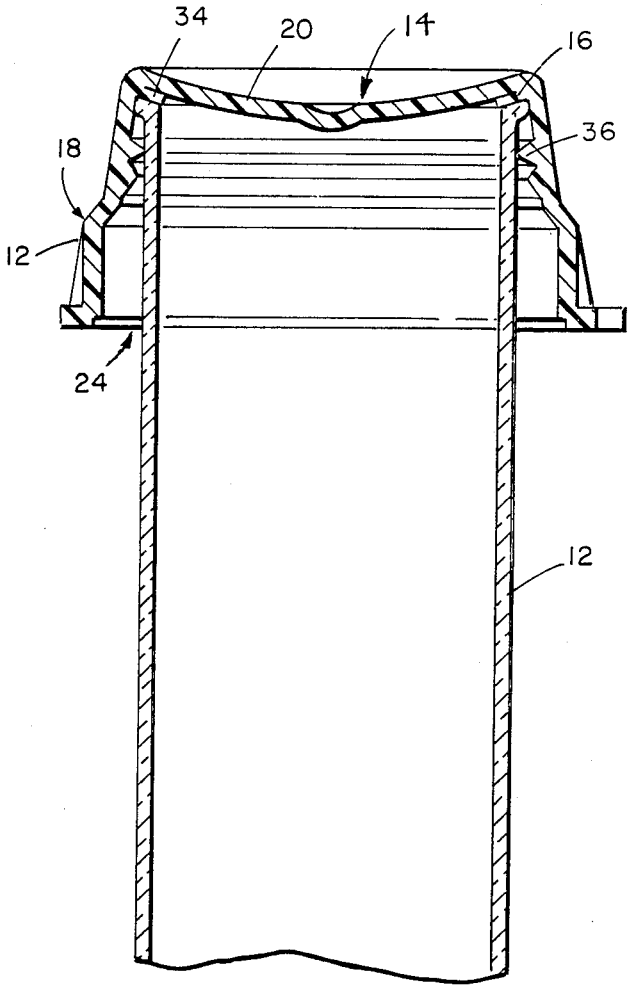
FIG. 2 is a cross-sectional view of the top of FIG. 1 sealing engagement with the test tube.
Figure 3:
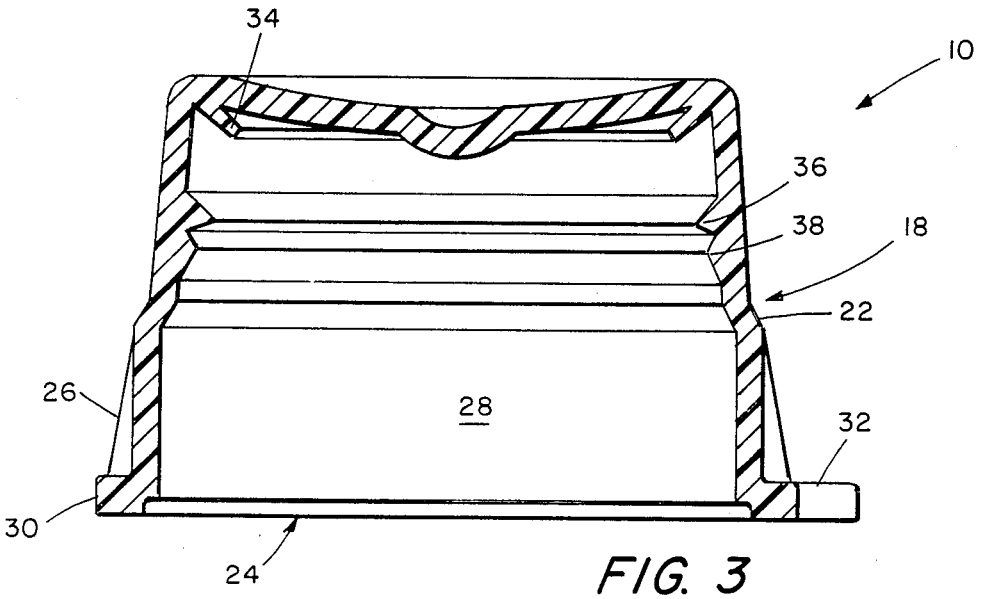
FIG. 3 is an enlarged cross-sectional view of the top of FIG. 1.

As best shown in FIGS. 2 and 3, a sealing rib 34 extends inwardly from the upper interior corner of cap 10 into receiving area 28. Sealing rib 34 extends a sufficient length into receiving area 24 so that it is in sealing engagement with the top edge or lip 35 of test tube 12 as shown in FIG. 2. The closed end of top 10 is concaved so that sealing rib 34 is urged against lip 35 to provide a positive seal with test tube 12. The concaved surface of the closed end of top 10 biases the sealing rib 34 into sealing engagement with the lip 35 of the tubular body 12.

An annular gripping rib 36, which is formed in sidewall 24 below sealing rib 34, is operative to grippingly engage the sidewall of test tube 12 as shown in FIG. 2. Sealing rib 34 extends a greater distance into receiving area 28 than gripping rib 36. That is, the distance from the central axis of top 10 to the end of gripping rib 36 is greater than the distance from the central axis of top 10 to the ends of sealing rib 34. A lower rib 38 is formed in sidewall 22 below a gripping rib 36. Lower rib 38 extends a smaller distance into receiving area 28 than gripping rib 36 in order to facilitate placing of top 10 on test tube 12. That is, the distance from the central axis of top 10 to the ends of lower rib 38 is greater than the distance from the central axis of top 10 to the ends of gripping rib 36.

As shown in FIG. 2, when top 10 is placed on test tube 12, sealing rib 34 is in sealing engagement with lip 35 and gripping rib 36 is in gripping engagement with the sidewall of test tube 12. Gripping rib 36 enhances the sealing capabilities of top 10 by providing a sealing contact with the sidewall of test tube 12.

As previously indicated, tab 32 is provided to facilitate removal of top 10 from test tube 12. The top 10 is removed by positioning the thumb nail of the person removing top 10 under tab 32 and pushing the tab upwardly until the top is off test tube 12. As the top 10 is removed from the test tube 12, gripping rib 36 passes over rim 16 and lower rib 38 contacts the rim. This arrangement allows gradual breaking of the seal between top 10 and test tube 12. Any gases within the test tube 12 gradually escape without appreciable turbulence within the tube. In the case of liquids within test tube 12, gradual breaking of the seal permit gases to escape without causing the liquids to aerosol.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A top for sealing the opened end of a tubular member, said top comprising:

(a) a tubular body with a closed upper end, a depending sidewall and an opened lower end, an open ended chamber formed by said closed upper end and depending sidewall, said lower opened end of said chamber defining an entrance which is configured to receive the tubular member to be sealed;

(b) an annular interior sealing rib formed at the upper end of said tubular body, said sealing rib extending inwardly into said chamber to sealingly engage a lip at the opened end of the tubular member received is said chamber;

(c) an annular interior gripping rib formed in said sidewall below said sealing rib, said gripping rib configured to grippingly engage the sidewall of the tubular member received in said chamber, said sealing rib extending a greater distance into said chamber than said gripping rib; and (d) an annular interior lower rib formed in said sidewall below said gripping rib, said lower rib extending a smaller distance into said chamber than said gripping rib, said lower rib being out of contact with the side wall of the tubular member received in said chamber when said sealing rib is in engagement with the lip and said gripping rib is in engagement with the sidewall, said lower rib being adapted to engage the lip of the tubular member upon removal of said top therefrom, whereby the seal between the tubular member and said top is broken gradually.

2. The top as claimed in claim 1 wherein a lower potion of said tubular body is formed with an outwardly flared skirt portion which defines an enlarged entrance which is configured to receive the tubular member to be sealed.

3. The top as claimed in claim 2 including an external tab formed at the lower end of said skirt portion of said tubular body, said tab defining a purchase for removing said top from the tubular member.

4. The top as claimed in claim 1 wherein said closed end of said tubular body has a concaved surface for biasing said sealing rib into sealing engagement with the lip of the tubular member.

5. A top for sealing the opened end of a tubular member with a lip said top comprising:

(a) a tubular body with a closed upper end, a depending sidewall and an opened lower end, an open ended chamber formed by said closed upper end and depending sidewall, said lower opened end of said chamber defining an entrance which is configured to receive the tubular member to be sealed;

(b) an annular interior sealing rib formed at the upper end of said tubular body, said sealing rib extending inwardly into said chamber to sealingly engage a lip at the opened end of the tubular member received in said chamber;

(c) an annular interior gripping rib formed in said sidewall below said sealing rib, said gripping rib configured to grippingly engage the sidewall of the tubular member received in said chamber, said sealing rib extending a greater distance into said chamber than said gripping rib; and (d) an annular interior lower rib formed in said sidewall below said gripping rib, said lower rib extending a smaller distance into said chamber than said gripping rib to facilitate placing of said top on the tubular member to be sealed, gradual breaking of the seal when the top is, said lower rib being out of contact with the sidewall of the tubular member received in said chamber when said sealing rib is in engagement with the lip and said gripping rib is in engagement with the sidewall, said lower rib being adapted to engage the lip of the tubular member upon removal of said top therefrom, whereby the seal between the tubular member and said top is broken gradually.

6. A top for sealing the opened end of a tubular member with a lip, said top comprising:

(a) a tubular body with a closed upper end and a depending sidewall, said sidewall having a narrow upper section and an enlarged lower section, said tubular body having an internal chamber which is closed at upper end and opened only at its lower end, said upper section of said tubular member sized to snugly receive the tubular member which is to be sealed, said lower section of said tubular member sized to freely receive the tubular member which is to be sealed, the tubular member entering said receiving chamber through said lower opened end of said tubular body;

(b) an annular interior sealing rib formed at the upper interior corner of said tubular body, said sealing rib extending inwardly into said chamber to sealing engage a lip at the opened end of the tubular member received in said chamber;

(c) an annular interior gripping rib formed in said upper section of said sidewall below said sealing rib, said gripping rib configured to grippingly engage the sidewall of the tubular member received in said chamber, said sealing rib extending a greater distance into said chamber than said gripping rib; and (d) an annular interior lower rib formed in said upper section below said gripping rib, said lower rib extending a smaller distance into said chamber than said gripping rib, said lower rib being out of contact with the sidewall of the tubular member received in said chamber when said sealing rib is in engagement with the lip and said gripping rib is in engagement with the sidewall, said lower removal of said top therefrom, whereby the seal between the tubular member and said top is broken gradually.

7. The top as claimed in claim 6 wherein a lower section of said tubular body is formed with an outwardly flared skirt portion which defines an enlarged entrance which is configured to receive the tubular member to be sealed.

8. The top as claimed in claim 6 including an external tab formed at the lower end of said tubular body, said tab defining a purchase for removing said top from the tubular member.

9. The top as claimed in claim 6 wherein said closed end of said tubular body has a concaved surface for biasing said sealing rib into sealing engagement with the lip of the tubular member.

10. A top for sealing the opened end of a tubular member, said top comprising:

(a) a tubular body with a closed upper end and a depending sidewall, said sidewall having a narrow upper section and an enlarged lower section, said tubular body formed with an internal chamber which is closed at upper end and openly only at its lower end, said upper section of said tubular member sized to snugly receive the tubular member which is to be sealed, said lower section of said tubular member sized to freely receive the tubular member which is to be sealed, the tubular member entering said receiving chamber through said lower opened end of said tubular body;

(b) an annular interior sealing rib formed at the upper end of said tubular body, said sealing rib extending inwardly into said chamber to sealingly engage a lip at the opened end of the tubular member received in said chamber;

(c) an annular interior gripping rib formed in said upper section of said sidewall below said sealing rib, said gripping rib configured to grippingly engage the sidewall of the tubular member received in said chamber, said sealing rib extending a greater distance into said chamber than said gripping rib; and (d) an annular interior lower rib formed in said upper section below said gripping rib, said lower rib extending a smaller distance into said chamber than said gripping rib to facilitate placing of said top on the tubular member to be sealed, said lower rib being out of contact with the sidewall of the tubular member received in said chamber when said sealing rib is in engagement with the lip and said gripping rib is in engagement with the sidewall, said lower lip being adapted to engage the lip of the tubular member upon removal of said top therefrom, whereby the seal between the tubular member and said top is broken gradually.

11. A top for sealing the opened end of a tubular member, said top comprising:

(a) a tubular body with a closed upper end and a depending sidewall, said sidewall having a narrow upper section and an enlarged lower section, said tubular body having an internal chamber which is closed at upper end and opened only at its lower end, said upper section of said tubular member sized to snugly receive the tubular member which is to be sealed, said lower section of said tubular member sized to freely receive the tubular member which is to be sealed, the tubular member entering said receiving chamber through said lower opened end of (b) an annular interior sealing rib formed at the upper interior corner of said tubular body, said sealing rib extending inwardly into said chamber a sufficient distance to be in sealing engagement with a lip about the opened end of the tubular member received in said chamber;

(c) an annular interior gripping rib formed in said upper section of said sidewall below said sealing rib, said gripping rib configured to grippingly engage the sidewall of the tubular member received in said chamber, said sealing rib extending a greater distance into said chamber than said gripping rib; and (d) an annular interior lower rib formed in said upper section below said gripping rib, said lower rib extending a smaller distance into said chamber than said gripping rib, said lower rib being out of contact with the sidewall of the tubular member received in said chamber when said sealing rib is in engagement with the lip and said gripping rib is in engagement with the sidewall, said lower rib being adapted to engage the lip of the tubular member upon removal of said top therefrom, whereby the seal between the tubular member and said top is broken gradually;

(e) said closed end of said tubular body formed with a concaved surface for biasing said sealing rib into sealing engagement with the lip of the tubular member.

12. A top for sealing the opened end of a tubular member, said top comprising:

(a) a tubular body with a closed upper end and a depending sidewall, said sidewall having a narrow upper section and an enlarged lower section, said tubular body having an internal chamber which is closed at upper end and opened only at its lower end, said upper section of said tubular member sized to snugly receive the tubular member which is to be sealed, said lower section of said tubular member sized to freely receive the tubular member which is to be sealed, the tubular member entering said receiving chamber through said lower opened end of said tubular body;

(b) an annular interior sealing rib formed at the upper interior corner of said tubular body, said sealing rib extending inwardly into said chamber a sufficient distance to be in sealing engagement with a lip about the opened end of the tubular member received in said chamber;

(c) an annular interior gripping rib formed in said upper section of said sidewall below said sealing rib, said gripping rib configured to grippingly engage the sidewall of the tubular member received in said chamber, said sealing rib extending a greater distance into said chamber than said gripping rib; and (d) an annular interior lower rib formed in said upper section below said gripping rib, said lower rib extending a smaller distance into said chamber than said gripping rib to facilitate placing of said top on the tubular member to be sealed, said lower rib being out of contact with the sidewall of the tubular member received in said chamber when said sealing rib is in engagement with the lip and said gripping rib is in engagement with the sidewall, said lower rib being adapted to engage the lip of the tubular member upon removal of said top therefrom, whereby the seal between the tubular member and said top is broken gradually;

(e) said closed end of said tubular body formed with a concaved surface for biasing said sealing rib into sealing engagement with the lip of the tubular member.

13. The top as claimed in claim 12 wherein a lower potion of said tubular body is formed with an outwardly flared skirt portion which defines an enlarged entrance which is configured to receive the tubular member to be sealed.

14. The top as claimed in claim 13 including an external tab formed at the lower end of said skirt portion of said tubular body, said tab defining a purchase for removing said top from the tubular member.

15. The top as claimed in claim 14 wherein said tubular body, said sealing rib and said gripping rib are formed integrally as a unitary structure.

16. The top as claimed in claim 14 wherein said tubular body, said sealing rib, said gripping rib and said lower rib are formed integrally as a unitary structure.

* * * * *